US008998690B1

(12) United States Patent
Virag et al.

(10) Patent No.: US 8,998,690 B1
(45) Date of Patent: Apr. 7, 2015

(54) WINDOW MOUNTED SAFETY NET FOR AN AIR CONDITIONER

(76) Inventors: Joseph Stephen Virag, Ridgefield, CT (US); Douglas Birney Patrick, Newtown, CT (US)

( * ) Notice: Subject to any disclaimer, the term of this patent is extended or adjusted under 35 U.S.C. 154(b) by 92 days.

(21) Appl. No.: 13/527,825

(22) Filed: Jun. 20, 2012

Related U.S. Application Data

(63) Continuation-in-part of application No. 13/019,940, filed on Feb. 2, 2011, now Pat. No. 8,414,367.

(51) Int. Cl.
*F24F 13/32* (2006.01)
*F24F 1/04* (2011.01)

(52) U.S. Cl.
CPC .. *F24F 13/32* (2013.01); *F24F 1/04* (2013.01)

(58) Field of Classification Search
CPC ..... F24F 13/20; F24F 13/30; F24F 13/32; F24F 1/027; F24F 1/04; F24D 19/0209
USPC ..... 248/208, 209, 236, 339, 340; 62/262, 62/263, 331; 454/204, 198, 201, 202, 203, 454/205, 214, 215; 49/50, 56, 57; 296/152; 24/265 H, 306, 302, 182, 198–200; 119/484; 211/75, 87.01
See application file for complete search history.

(56) References Cited

U.S. PATENT DOCUMENTS 1,085,216 A * 1/1914 MacLeod ..... 182/230
1,499,841 A * 7/1924 Pepper ..... 43/119
1,585,592 A * 5/1926 McArthur ..... 312/242
1,918,073 A * 7/1933 Williams et al. ..... 160/328
2,000,554 A * 5/1935 Basch ..... 160/43
2,051,241 A * 8/1936 Biggers ..... 108/149
2,705,990 A * 4/1955 Miller ..... 150/165
2,711,769 A * 6/1955 Katcher et al. ..... 150/165
2,720,236 A * 10/1955 Hoffman ..... 150/165
2,826,472 A * 3/1958 Humphner ..... 312/101
2,917,111 A * 12/1959 Clarke ..... 160/91
2,978,973 A * 4/1961 Sweedyk et al. ..... 62/262
3,273,843 A * 9/1966 Bell, Jr. et al. ..... 248/208
4,108,084 A * 8/1978 Fink ..... 108/29
4,445,459 A * 5/1984 Julie ..... 119/28.5
4,498,374 A * 2/1985 Gibson ..... 454/204
4,510,852 A * 4/1985 Sorrentino ..... 454/204
4,691,477 A * 9/1987 Governale ..... 49/380
4,989,546 A * 2/1991 Cannaday ..... 119/484
5,193,955 A * 3/1993 Chou ..... 410/100
D334,636 S * 4/1993 Honeycutt ..... D30/124
5,443,110 A * 8/1995 Plott, Sr. ..... 160/368.1
5,469,807 A * 11/1995 Kosmaczeska ..... 119/484
5,879,048 A * 3/1999 Tower ..... 296/152
6,755,232 B1 * 6/2004 Holland et al. ..... 160/368.1
6,863,249 B1 * 3/2005 Alvord ..... 248/95
7,036,869 B1 * 5/2006 Stipanovich ..... 296/152
7,350,759 B1 * 4/2008 Gray ..... 248/644
7,841,467 B2 * 11/2010 Slayton ..... 206/315.1
D634,413 S * 3/2011 Wallace ..... D23/354
8,414,367 B1 * 4/2013 Virag et al. ..... 454/204
8,678,889 B2 * 3/2014 Dean ..... 454/354
2010/0281783 A1 * 11/2010 Harrington ..... 52/2.23

* cited by examiner

*Primary Examiner* — Jonathan Liu
*Assistant Examiner* — Guang H Guan
(74) *Attorney, Agent, or Firm* — Michael I. Kroll

(57) ABSTRACT

A safety net for a window air conditioner window mounted air conditioning unit. The safety net protects a window mounted air conditioning unit from falling from a window opening during installation, operation and removal thereof.

8 Claims, 18 Drawing Sheets

WINDOW MOUNTED SAFETY NET FOR AN AIR CONDITIONER

RELATED APPLICATIONS

This application is a Continuation-In-Part of U.S. patent application Ser. No. 13/019,940, having a filing date 2 Feb. 2011 now U.S. Pat. No. 8,414,367.

Please incorporate by reference all information in said patent applications into this continuation-in-part application.

BACKGROUND OF THE INVENTION

1. Field of the Invention

The present invention relates generally to air conditioning units and, more specifically, to a safety net for window mounted air conditioners. The integrity of an improperly mounted air conditioner can be compromised due to the vibrations of the unit during use thereby causing the air conditioner to plummet to the ground below thus creating a potentially costly and dangerous situation. Furthermore, the risk increases exponentially during installation and removal of the air conditioning unit as it is not mounted and is awkward to handle.

The present invention seeks to overcome these shortcomings by providing a safety net that is installed prior to the installation of the air conditioner and replaceably removed upon removal of the unit. The net is manufactured of a high tensile material such as wire, cable or dense fiber and includes a plurality of cinching rings to conform to the size of the air conditioner unit.

2. Description of the Prior Art

There are other safety systems designed for window mounted air conditioning units. While these systems may be suitable for the purposes for which they where designed, they would not be as suitable for the purposes of the present invention as heretofore described.

SUMMARY OF THE PRESENT INVENTION

A primary object of the present invention is to provide a safety net to prevent a window mounted air conditioning unit from inadvertently falling from the window.

Another object of the present invention is to provide a window mounted air conditioning unit safety net having an anchoring device that secures to the interior or exterior of a window structure.

Yet another object of the present invention is to provide a window mounted air conditioning unit safety net wherein the net is manufactured of high tensile material such as wire, cable or high density fiber.

Still yet another object of the present invention is to provide a window mounted air conditioning unit safety net further comprising an air conditioning fitted cable that fits snugly around the periphery of the body that optionally provides for adjustment.

An additional object of the present invention is to provide a window mounted air conditioning unit safety net having integral horizontal upper and lower support lines extending beyond the netting for securing to the anchoring device.

A further object of the present invention is to provide a window mounted air conditioning unit safety net wherein the support lines have mounting rings disposed on the distal ends thereof.

A yet further object of the present invention is to provide a window mounted air conditioning unit safety net wherein the mounting rings are removably secured to their respective anchoring devices with removable clips.

A still yet further object of the present invention is to provide a window mounted air conditioning unit safety net that is installed prior to installation of the air conditioning unit.

Another object of the present invention is to provide a window mounted air conditioning unit safety net that is removed after the air conditioning unit has been pulled from the window opening.

Additional objects of the present invention will appear as the description proceeds.

The present invention overcomes the shortcomings of the prior art by providing a window mounted air conditioning unit safety net that protects a window mounted air conditioning unit from falling from a window opening during installation, operation and removal thereof.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
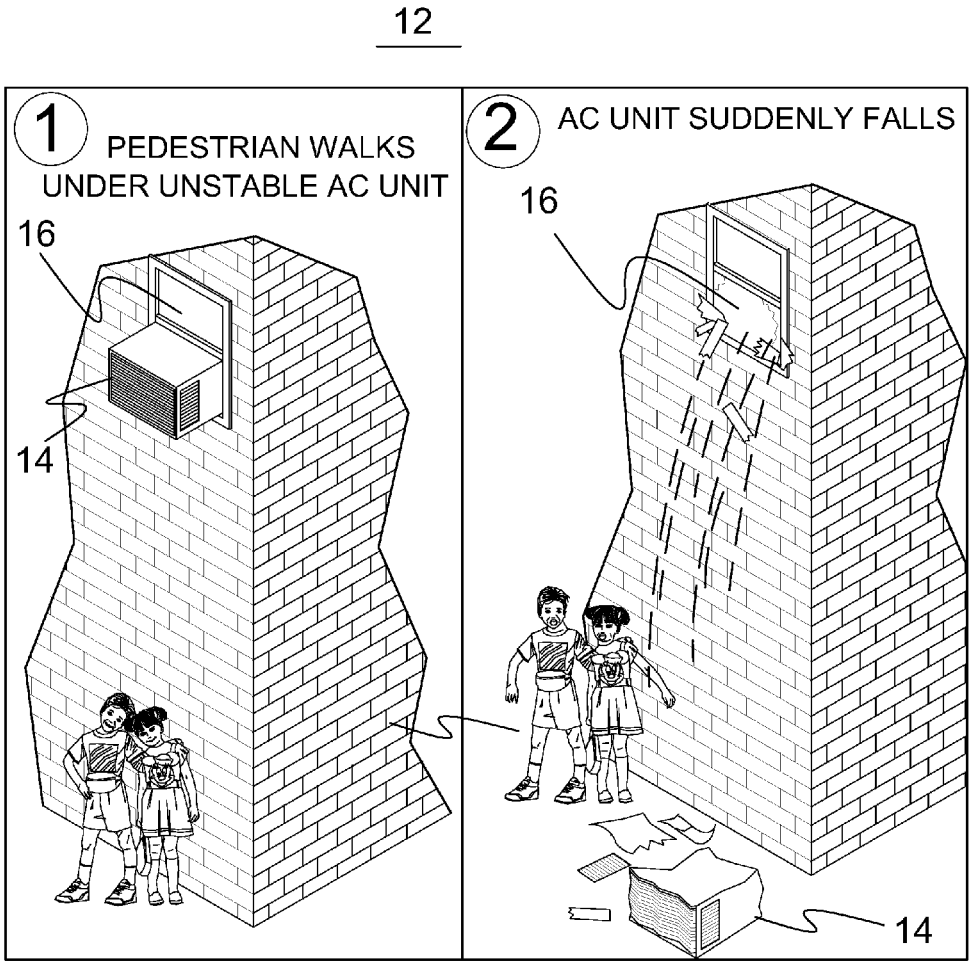
PRIOR ART FIG. 1
FIG. 1 is an illustrative view of the prior art.

Turning now descriptively to the drawing figures, in which similar reference characters denote similar elements throughout the several views, the figures illustrate the Window Mounted Air Conditioning Unit Safety Net of the present invention. With regard to the reference numerals used, the following numbering is used throughout the various drawing figures.

10 Window Mounted Air Conditioning Unit Safety Net of the present invention
12 prior art
14 window mounted air conditioning unit
16 window
18 pedestrian
20 net assembly
22 net webbing
24 support cable
26 upper support cable
28 lower support cable
30 cinching ring
32 mounting ring
34 support frame of 16
36 mounting assembly
38 structure of building
40 anchoring device
42 removable clip
44 eyelet of 40
46 fitted cable
48 rail of window sash
50 anterior elastic band
52 elastic strap
54 tether strap
56 clip
58 buckle
60 feed lock mechanism
62 saw tooth edge
64 hook and loop fastener

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the prior art. Many window mounted air conditioners 14 are not professionally installed with structurally mounted brackets, which would support the air conditioner, but are simply placed in a window 16 with the window sash lowed onto the air conditioner serving as anchoring element for the air conditioner. Since most of the weight of an air conditioner is in the back half, installation is problematic in an open window. The present invention provides a netting envelope for an air conditioner with straps having clips that can be attached to the rail of the window sash prior to positioning the unit in an open window.

Figure 2:
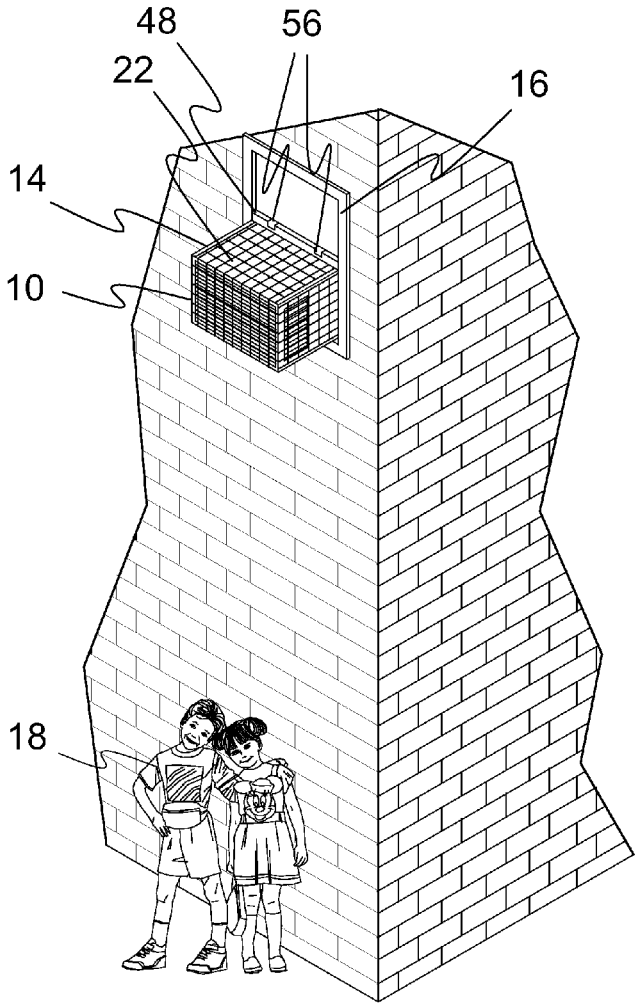
FIG. 2 is an illustrative view of the air conditioner safety net of the present invention in use.

Referring to FIG. 2, shown is an illustrative view of the present invention in use. The safety net 10 provides a netting receptacle 22 for encompassing the side walls and back wall of an air conditioner 14 that will prevent the air conditioner from falling out the window, even if the window is opened, by virtue of a pair of strap extending from the netting enclosure having a pair of clip 56 that are fastened to the top rail 48 of the window 16 sash thereby preventing any pedestrians 18 from harm during installation, operation or removal of the air conditioner.

Figure 3:
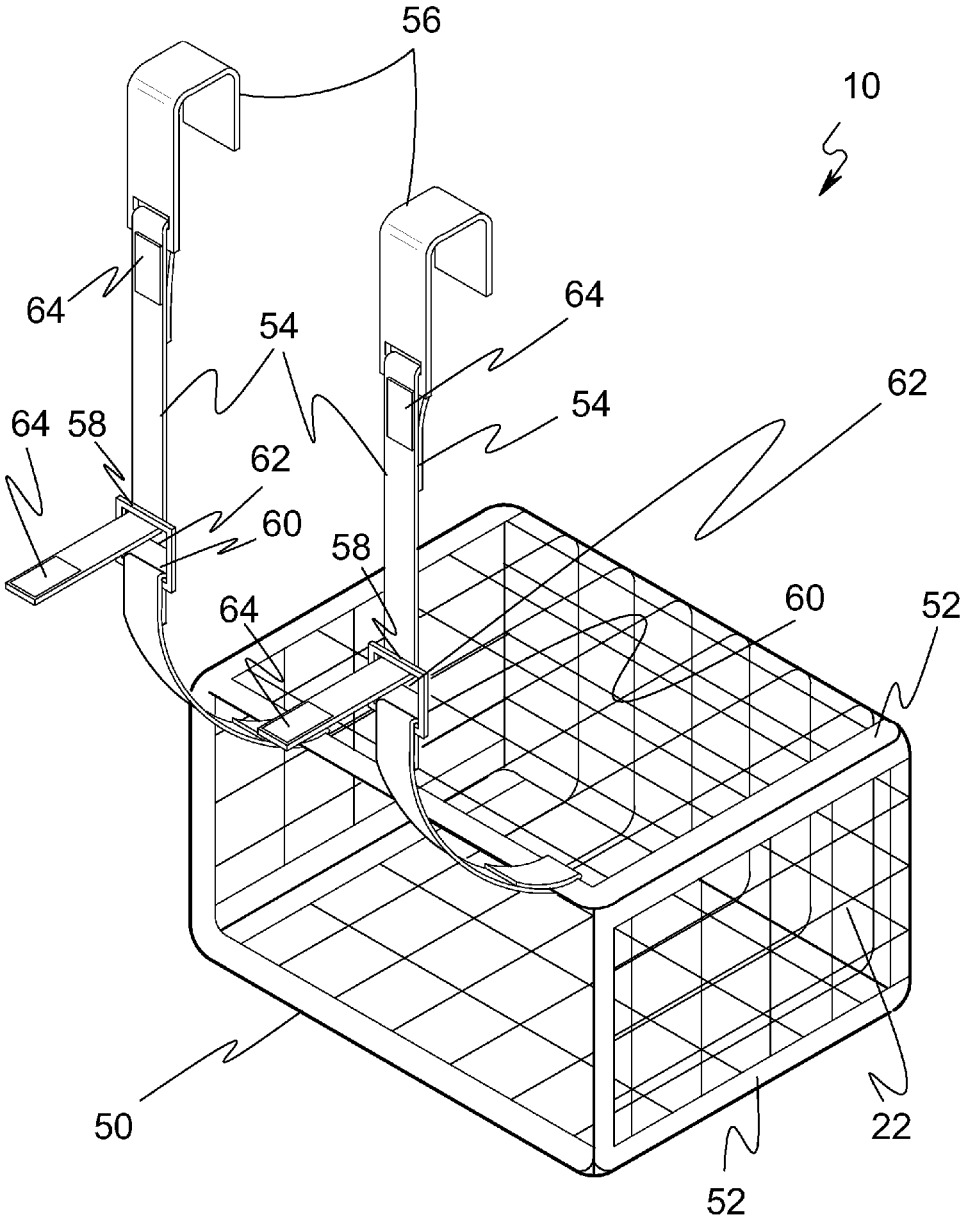
FIG. 3 is an orthographic view of the air conditioner safety net of the present invention.

Referring to FIG. 3, shown is an orthographic view of the air conditioner safety net of the present invention. The safety net 10 of the present invention encloses the side walls and back wall of an air conditioning unit with netting 22 having elastic strap 50 circumferentially attached to the anterior opening of the netting enclosure 22 and longitudinal elastic straps 52 extending from the front four corner edges terminating at the back wall of netting envelope 22 thereby providing that the netting envelope 22 will accommodate air conditioners of varying sizes. The anchoring mechanism of the netting enclosure 22 is a pair of tether straps 54 fastened to the anterior top edge of netting enclosure 22 and terminating in a pair of fixedly attached clips 56 that are attached to the top rail of either the lower or upper window sash. Each of the pair of straps 54 is comprised of a pair of dual straps having a buckle 58 therebetween with one strap portion fixed to the anterior top edge of netting enclosure 22 and the other end fixedly attached to buckle 58. The top strap portion is fixed to clip 56 then having a free end that is feed through buckle 58 with strap 54 engaging a feed lock mechanism 60 that will prevent the strap from freely feeding back through buckle 58 with the free end attachable approximate the clip 56 end by means of mating fasteners 64. One fastener portion is fixed approximate the strap free end and the mating fastener fixed approximate the clip end of the strap. Preferably the feed lock mechanism 60 has a tensioned pivotal plate with a saw tooth edge 62 engaging the strap.

Figure 4:
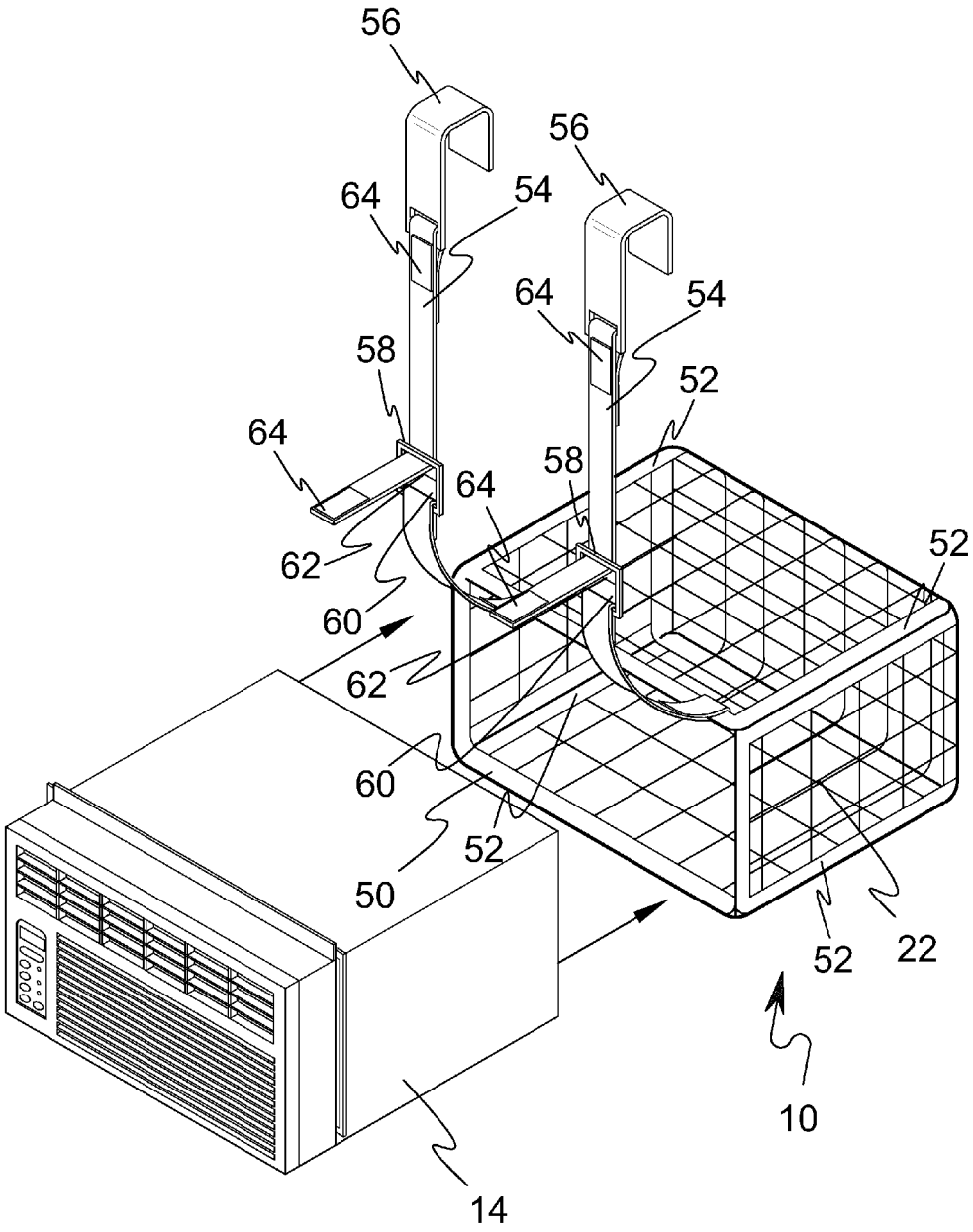
FIG. 4 is an illustrative perspective view of an air conditioner ready to be placed within the safety net.
Figure 5:
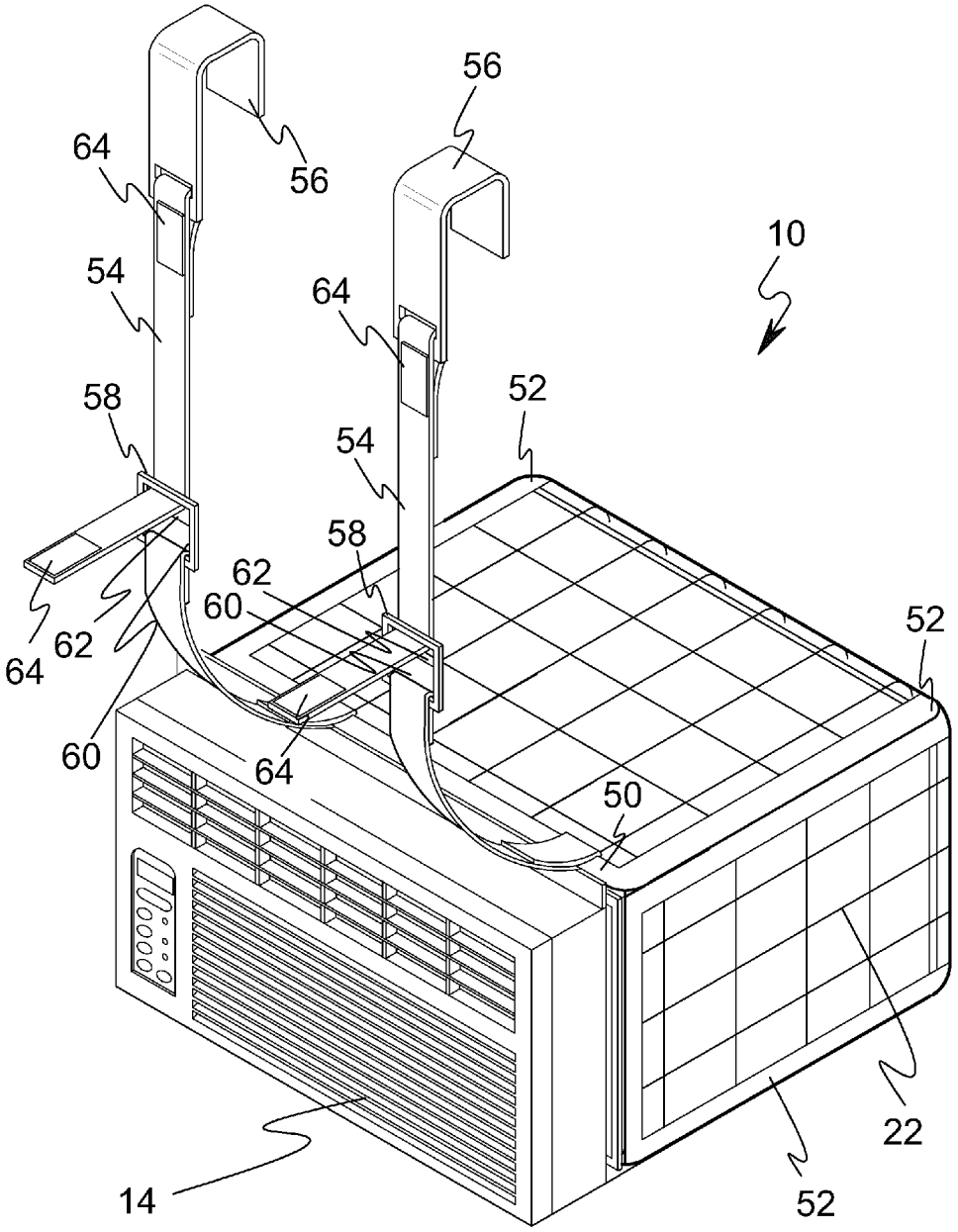
FIG. 5 is an illustrative perspective view of the safety net encompassing the sides and back of the air conditioner.
Figure 6:
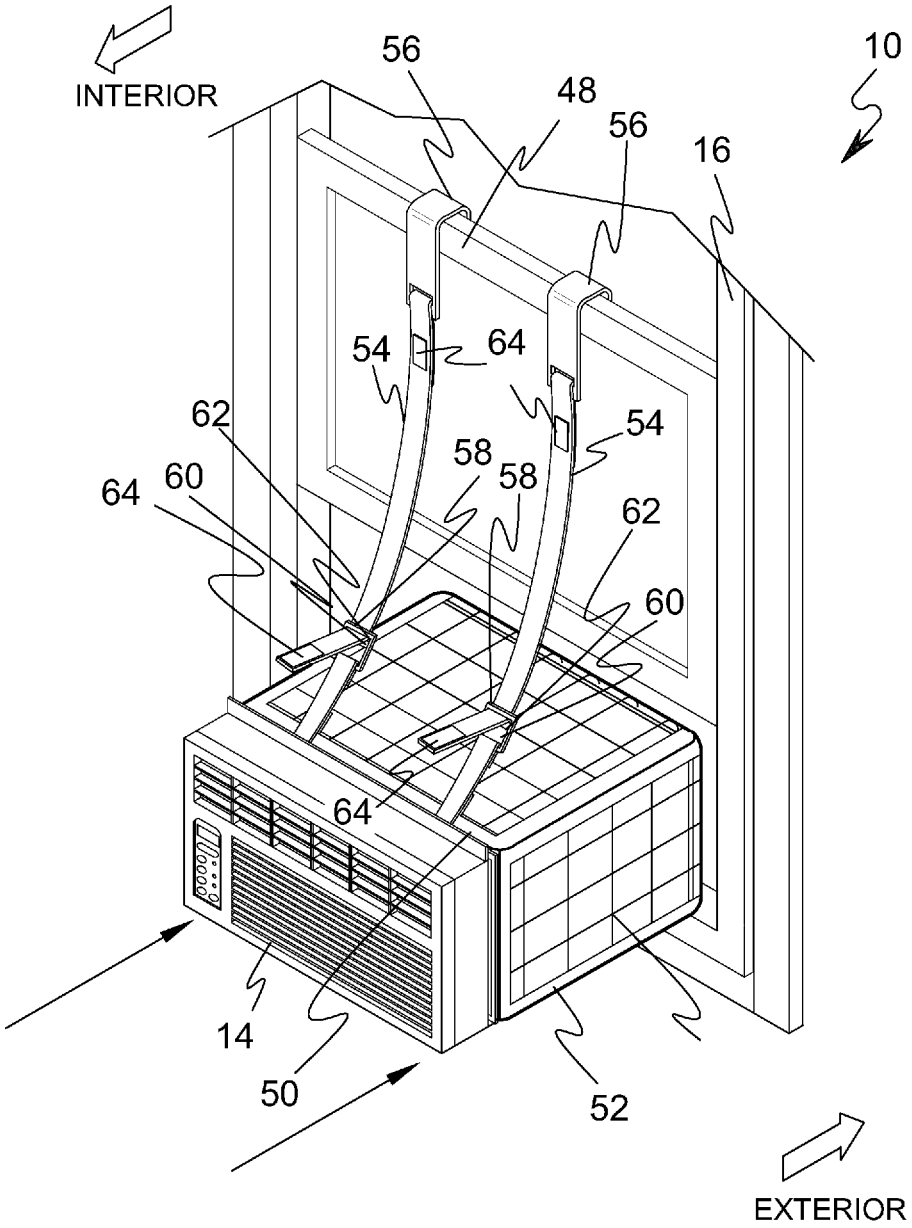
FIG. 6 is an illustrative perspective view of the safety net encompassed air conditioner being placed within an open window.
Figure 7:
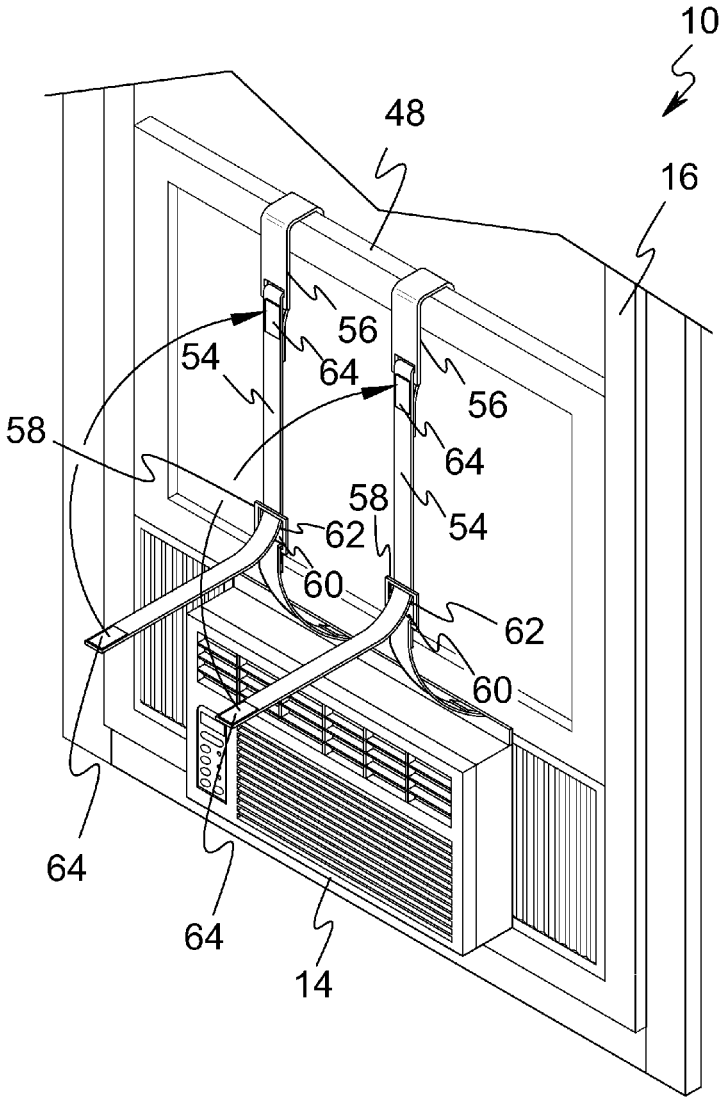
FIG. 7 is an illustrative perspective view of the safety net encompassed air conditioner seated within a window opening.
Figure 8:
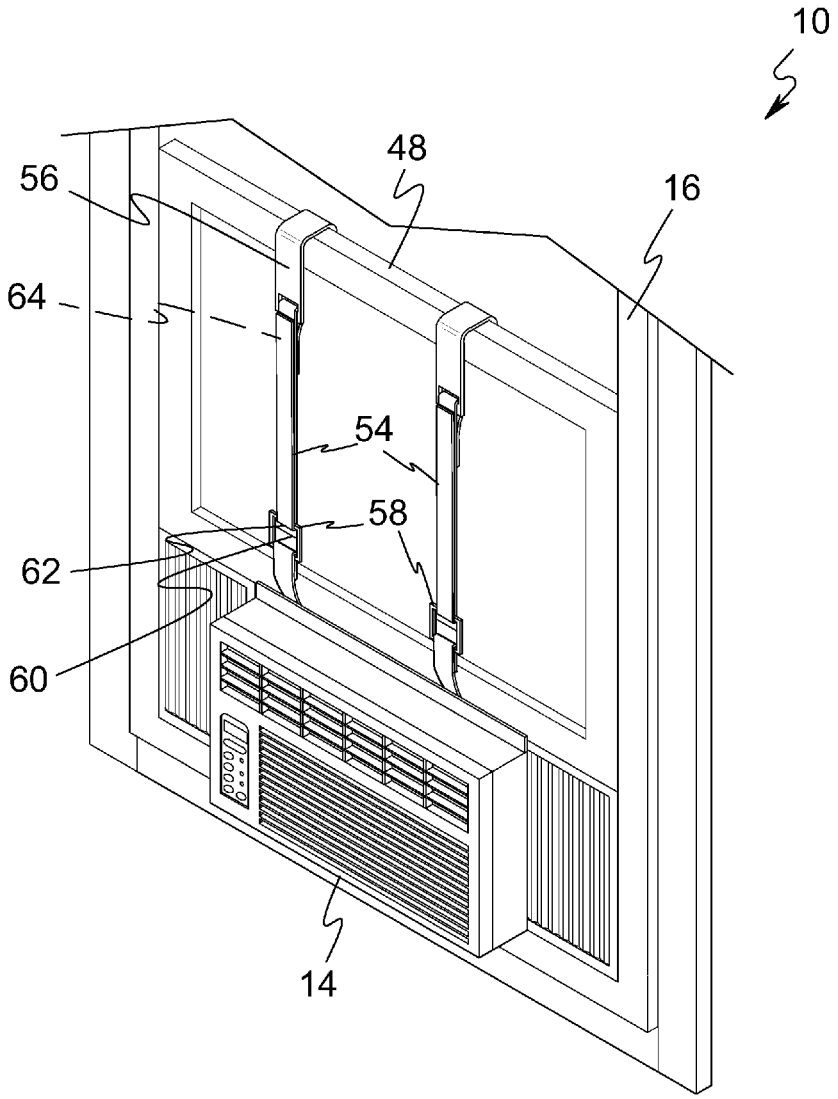
FIG. 8 is an illustrative perspective view of the safety net straps secured in a seated position.

Referring to FIGS. 4 through 8, shown is an illustrative perspective view of an air conditioner ready to be placed within the safety net. Referring to FIGS. 4 and 5, shown is an orthographic view of the air conditioner being inserted into the netting enclosure safety net 10 of the present invention. The safety net 10 of the present invention encloses the side walls and back wall of the air conditioning unit 14 with netting 22 having a circumferential anterior elastic strap 50 fixedly attached to netting enclosure 22 along with longitudinal elastic straps 52 that are also fixedly attached to netting enclosure 22 extending from the front four corner edges terminating at the back wall of netting envelope 22 thereby accommodating air conditioners of varying length, width and depth. Each of the pair of straps 54 is comprised of a pair of dual straps having a buckle 58 therebetween with one strap portion fixed to the anterior top edge of netting enclosure 22 and the other end fixedly attached to buckle 58. The top strap portion is fixed to clip 56 with a free end feed through buckle 58 engaging a feed lock mechanism 60 that will prevent the strap from freely feeding back through buckle 58. Referring to FIGS. 6 through 8, shown is an orthographic view of the air conditioner being placed in a window opening. As aforementioned, the free end of strap 54 is feed through buckle 58 with strap 54 engaging feed lock mechanism 60 preventing the strap from feeding back through the buckle. The air conditioner is positioned approximate the window opening whereupon clips 56 are attached to the top rail 48 of window 16, since the strap clips 56 are mounted on window sash 56, should the air conditioner fall out the window the safety net will prevent the air conditioner from falling further then the length of the straps. Once the air conditioner is properly positioned, as shown in FIG. 7, the window sash is lowered into engagement with the air conditioner. Wherethen the free end of the straps are pulled tight within the buckle and the free end is then attached approximate the clip 56 end by means of mating fasteners 64.

Figure 9:
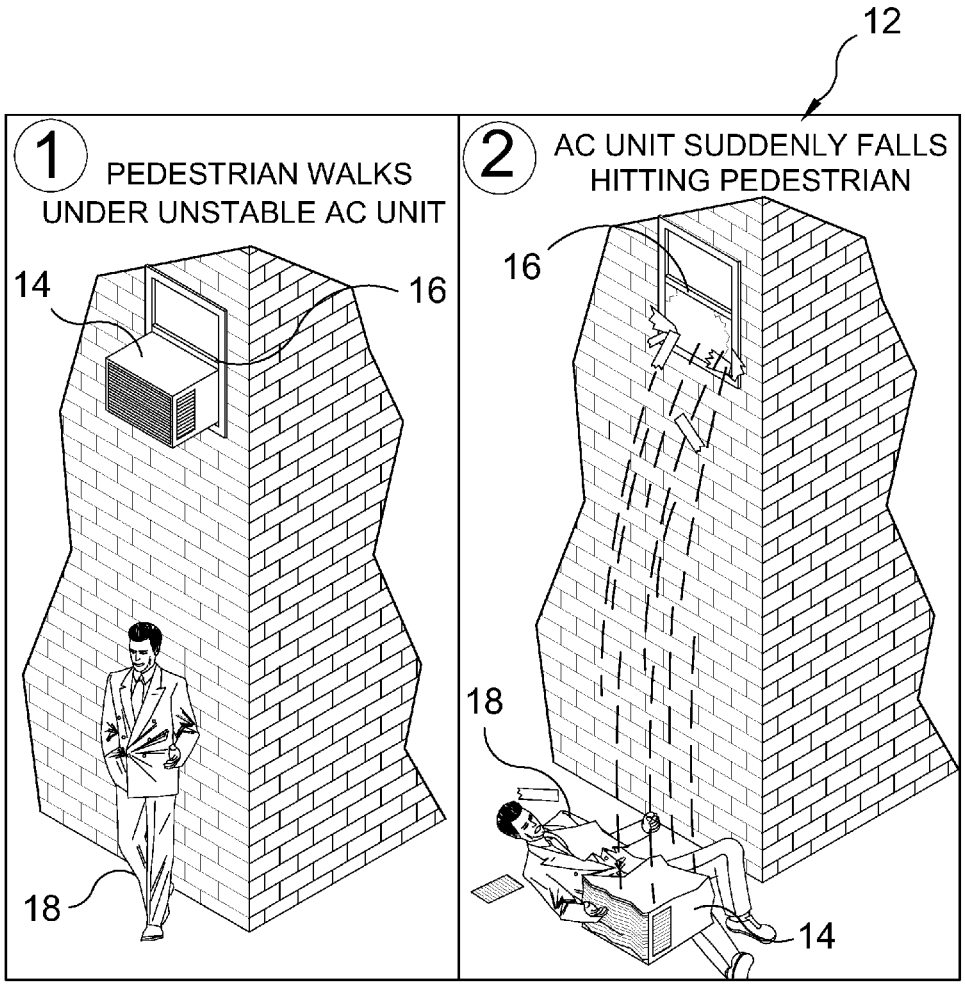
PRIOR ART FIG. 9
FIG. 9 is an illustrative view of the prior art.

Referring to FIG. 9, shown is an illustrative view of the prior art 12. Currently, air conditioner units 14 installed in windows 16 are at great risk of falling out of a window 16 due to poor installation or faulty mounting apparatus and risk of falling during installation and removal thereby endangering pedestrians 18 passing therebelow and costly damage to the air conditioner 14 and other material in the drop zone. The present invention provides an air conditioning unit safety net that is installed prior to the installation of the air conditioning unit 14.

Figure 10:
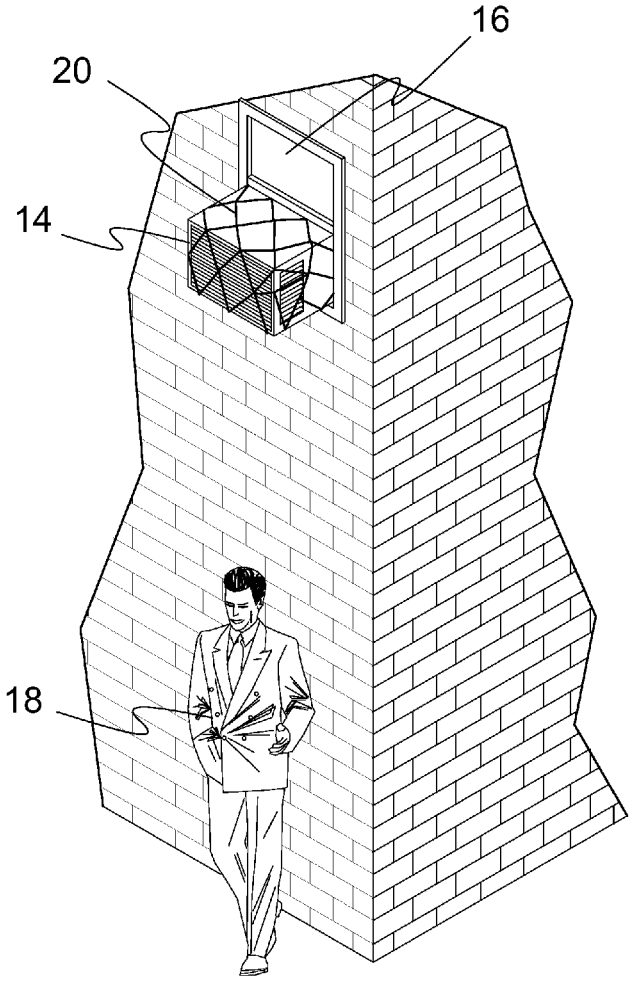
FIG. 10 is an illustrative view of the present invention in use.

Referring to FIG. 10, shown is an illustrative view of the present invention in use. The present invention is an air conditioner safety net 20 that is installed prior to the installation of a window mounted air conditioner unit 14 in a window 16 to secure the AC unit and eliminate the possibility of the unit falling from the window opening to the ground and injuring a pedestrian 18 or damaging material. The safety net 20 is secured to the buildings structure, internally or externally.

Figure 11:
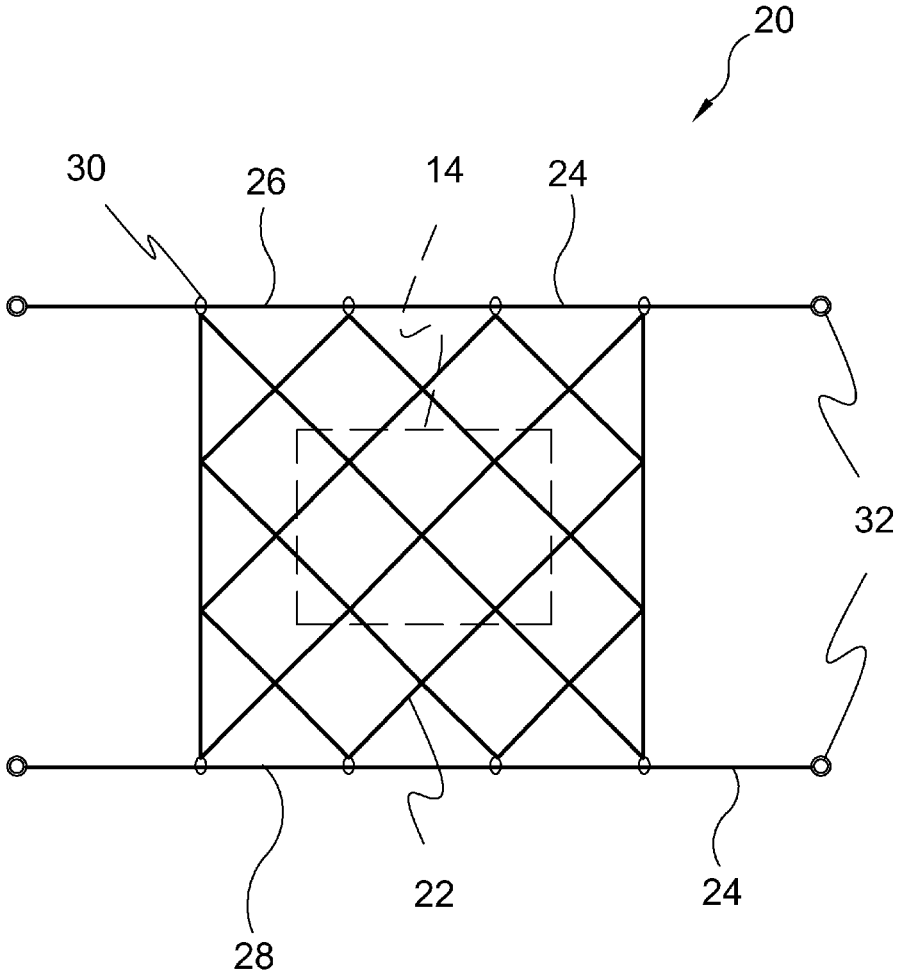
FIG. 11 is an orthographic view of the present invention.

Referring to FIG. 11, shown is an orthographic view of the present invention. Shown is the net assembly 20 of the present invention having a net webbing 22 that encompasses the air conditioner unit 14 with a pair of spaced apart horizontal support cables 24 forming an upper support cable 26 and a lower support cable 28 with the net webbing 22 affixed to the support cables 24 by a plurality of cinching rings 30 that slide freely along their respective support cables 24. Mounting rings 32 are disposed on the distal ends of the support cables 24 to provide fastening means to the building structure.

Figure 12:
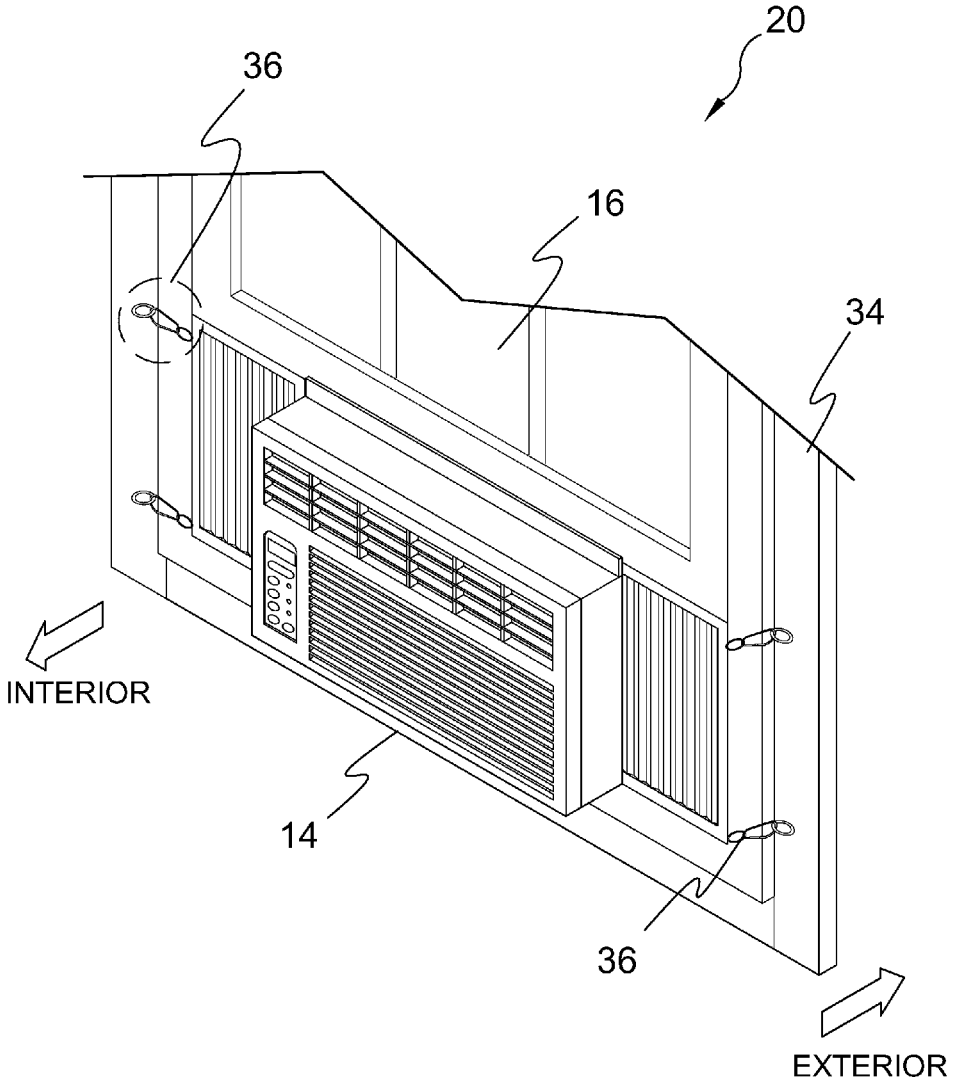
FIG. 12 is an illustrative perspective view of the present invention in use.

Referring to FIG. 12, shown is an illustrative perspective view of the window mounted air conditioner safety net 20 of the present invention in use. Shown is an indoor view of an air conditioner 14 installed in a window 16 and secured to the support frame 34 of the window 16 with a plurality of mounting assemblies 36.

Figure 13:
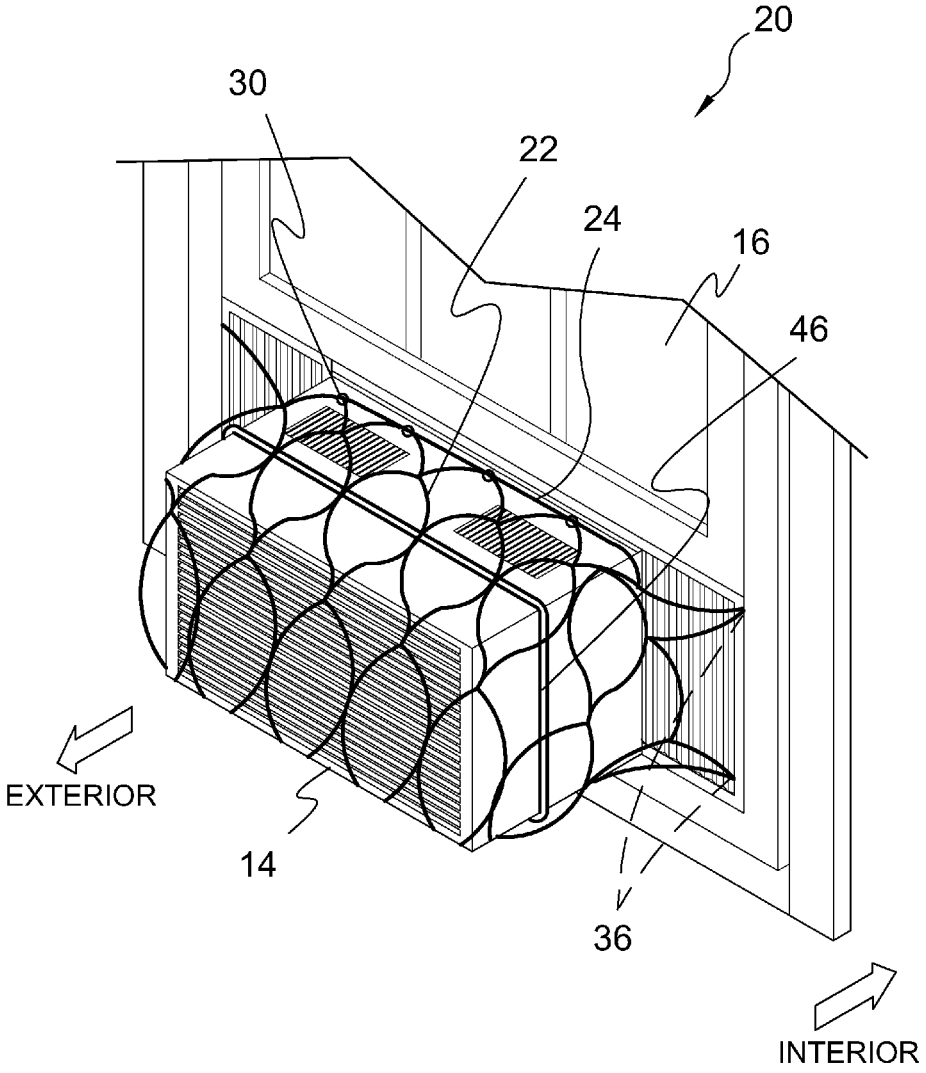
FIG. 13 is an illustrative perspective view of the present invention in use.

Referring to FIG. 13, shown is an illustrative perspective view of the present invention in use. Shown is an outdoor view of an air conditioner unit 14 having the air conditioner safety net 20 securing it to the window 16. The net webbing 22 encompasses the unit and the cinching rings 30 are appropriately gathered along the support cables 24 which lead to the mounting assemblies 36. Also shown is an optional fitted cable 46, which may be provided in the plurality to accommodate the various sizes of air conditioning units.

Figure 14:
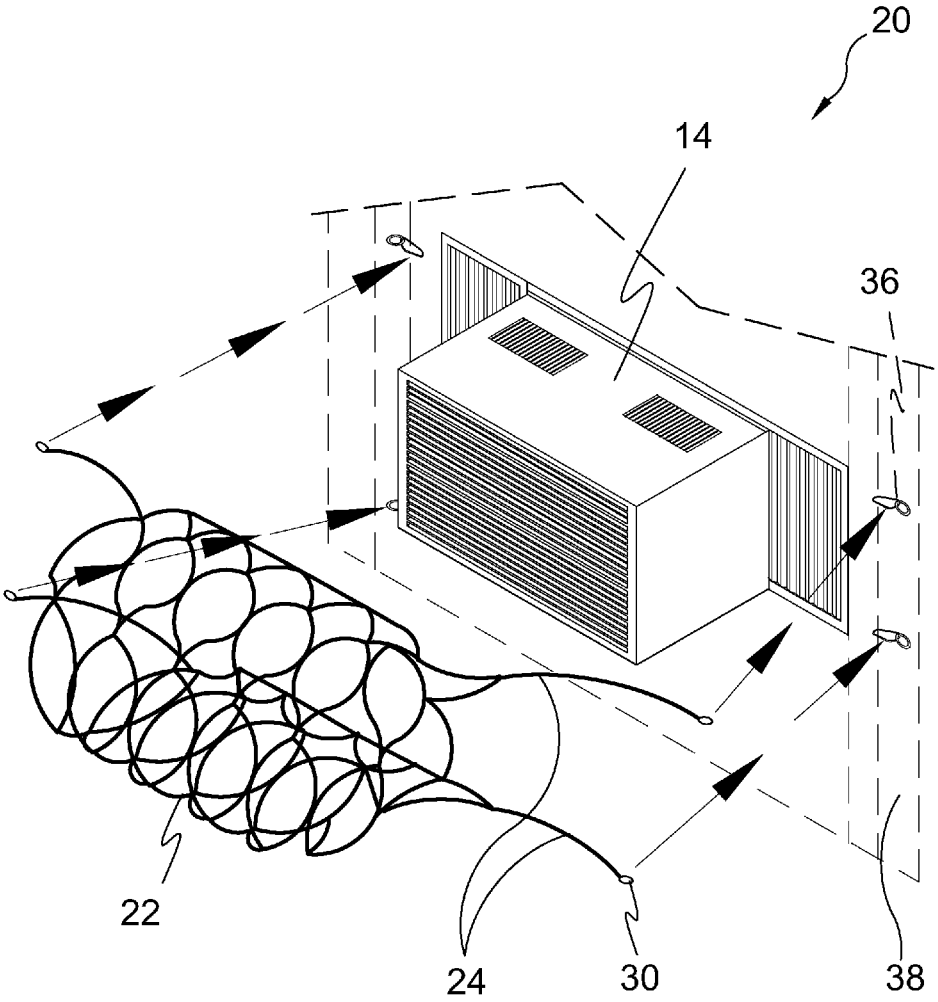
FIG. 14 is an illustrative perspective view of the present invention in use.

Referring to FIG. 14, shown is an illustrative perspective view of the present invention in use. Shown is an outdoor view of an air conditioner 14 having the air conditioner unit safety net 20 of the present invention unattached from the buildings structure 38. The safety net 20 can be secured to the building structure 38 inside or outside said building depending upon the building facade. Mounting loops 32 disposed on the distal ends of the support cables 24 are utilized for fastening the net webbing 22 to the mounting assemblies 36.

Figure 15:
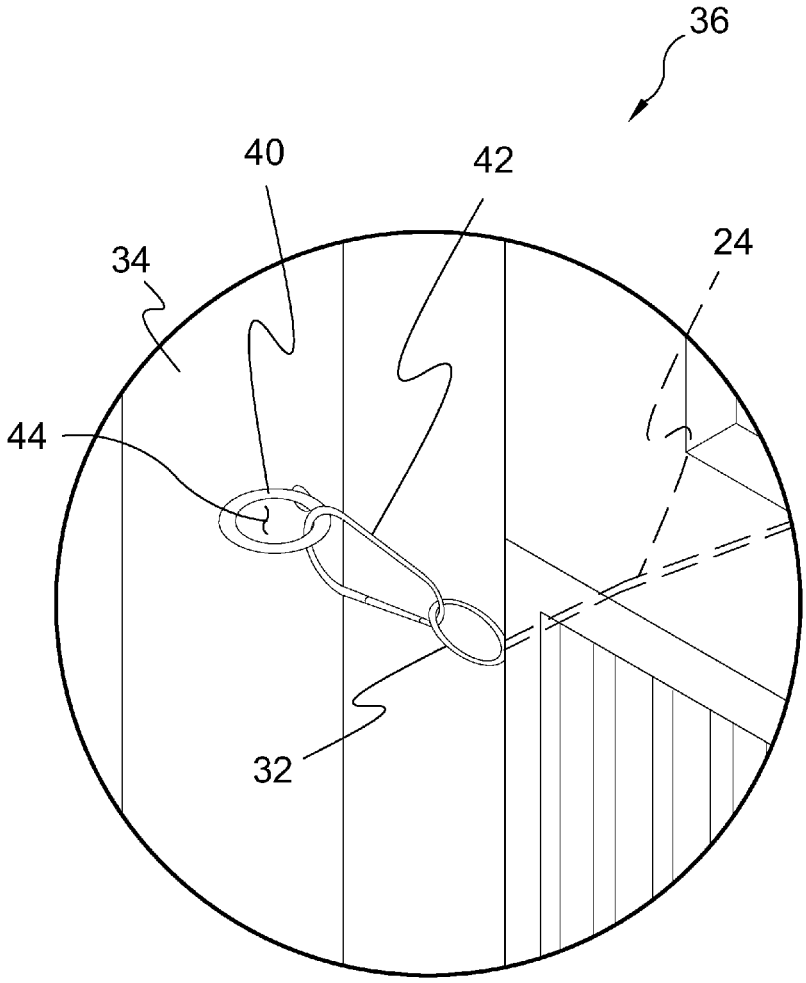
FIG. 15 is a detailed view of the safety net securing means of the present invention.

Referring to FIG. 15, shown is a detailed view of the safety net mounting assembly 36 of the present invention. Shown is a detailed view of the means of securing the safety net to a building structure using anchor devices 40 with eyelets 44 either inside or outside the support frame 34 supplemented for proper installation with masonry anchors or wood screws depending upon the building facade construction type. The mounting rings 32 on the support cables 24 of the safety net can be attached to the anchor devices 40 with a spring clip, carabineer or other type of removable clip 42.

Figure 16:
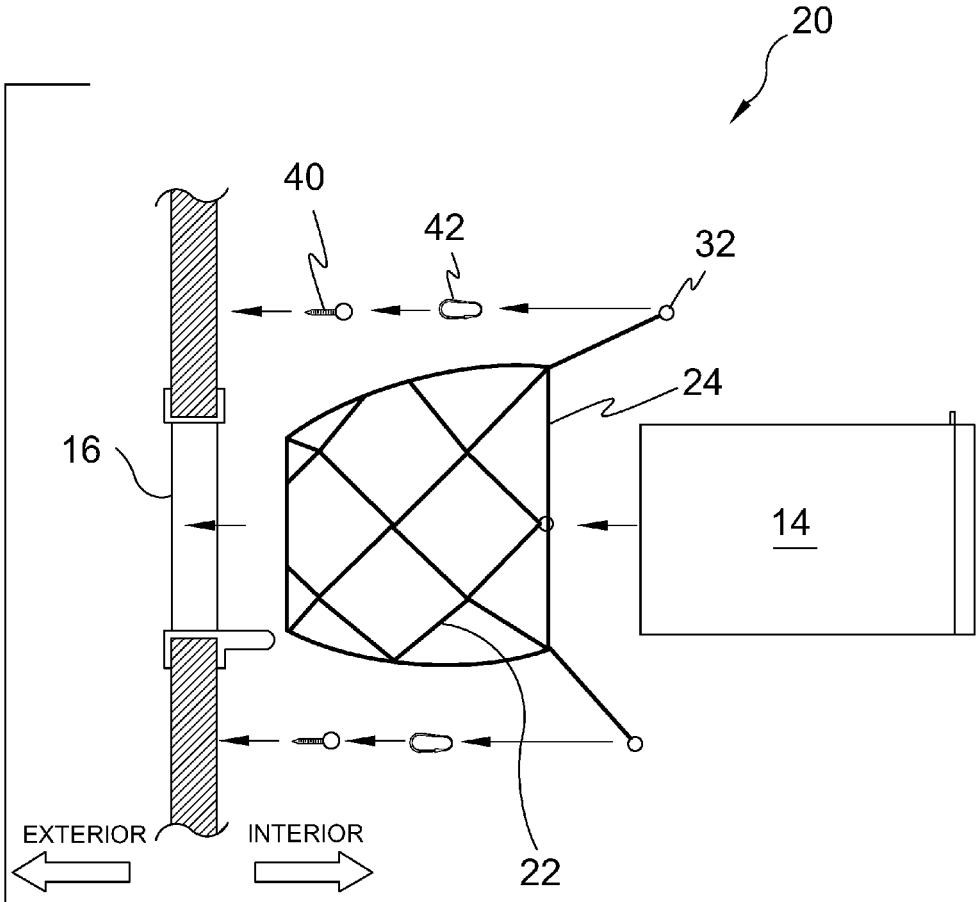
FIG. 16 is an exploded side view of the present invention.

Referring to FIG. 16, shown is an exploded side view of the window mounted air conditioner unit safety net 20 of the present invention. Shown is the net webbing 22 with support cables 24 and affiliated mounting rings 32, the anchoring device 40, removable clip 42, the air conditioning unit 14 and the window 16 in which it is to be installed.

Figure 17:
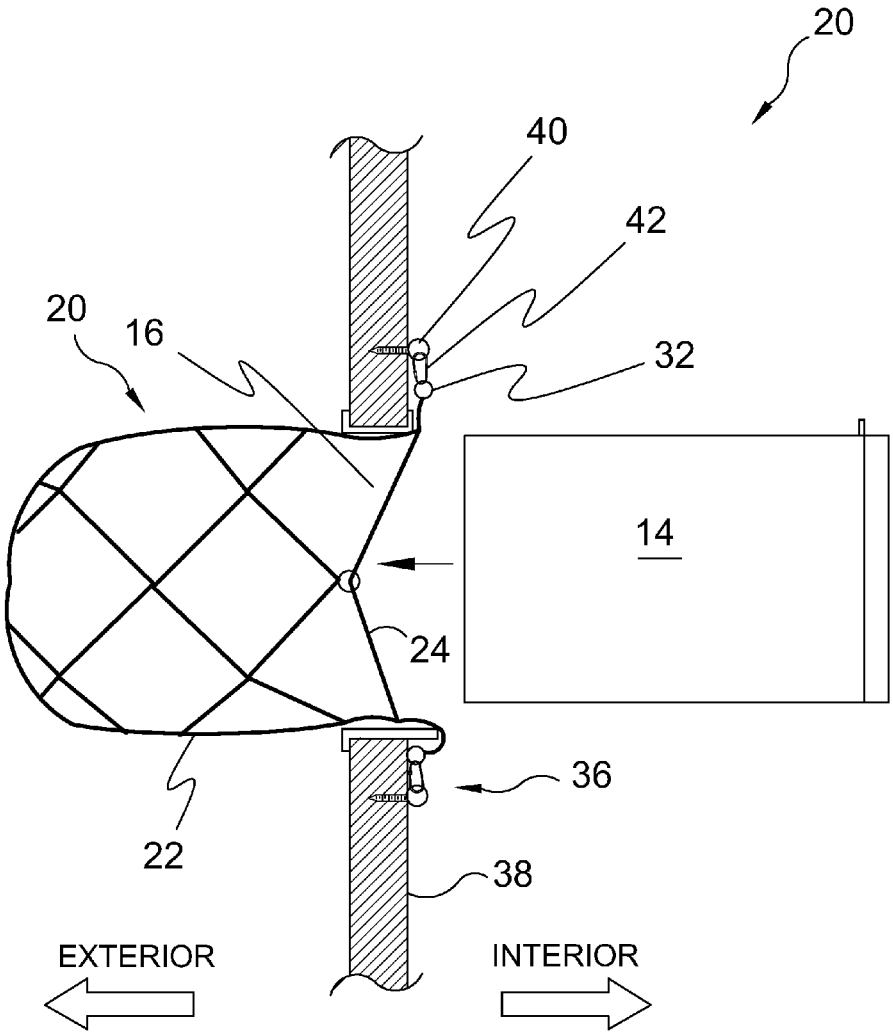
FIG. 17 is a side view of the present invention.

Referring to FIG. 17, shown is a side view of the present invention. Shown is a side view of the window mounted air conditioning unit safety net 20 of the present invention mounted internally to a window 16 of a building structure 38. Shown is the net assembly 20 comprising a net webbing 22 having support cables 24 and mounting rings 32 disposed on the distal ends thereof. Also shown are mounting assemblies 36 comprising an anchoring device 40 and removable clip 42. The air conditioning unit 14 is then inserted into the net webbing 22.

Figure 18:
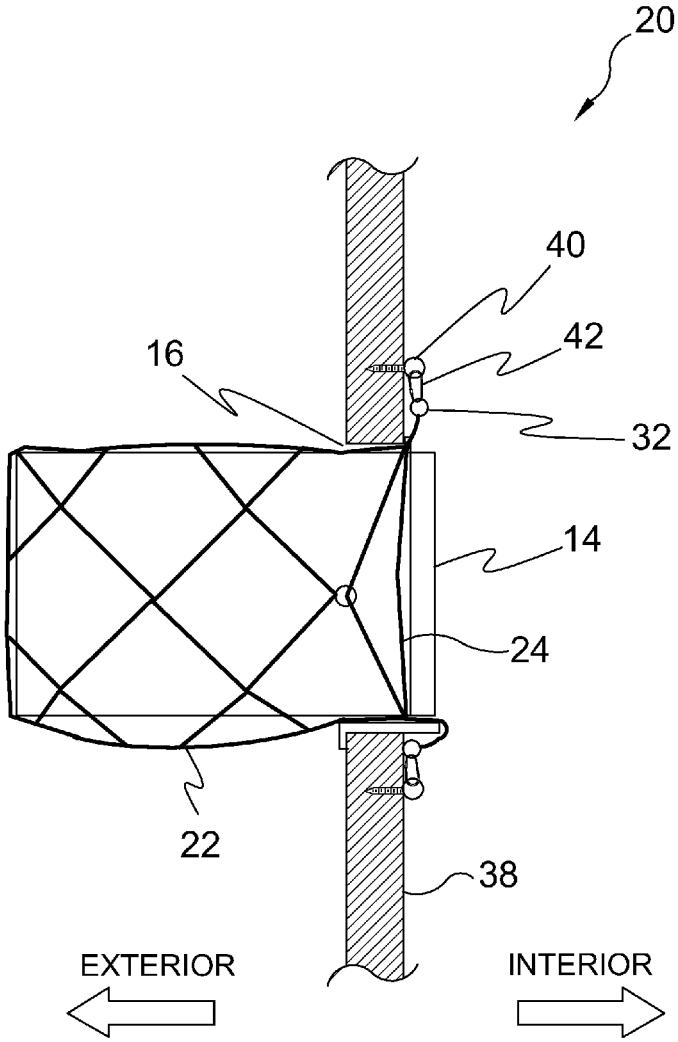
FIG. 18 is a side view of the present invention.

Referring to FIG. 18, shown is a side view of the present invention. Shown is a side view of the air conditioning unit safety net 20 mounted internally to the window 16 of a building structure 38 using an eye screw anchor device 40 with a spring clip, carabineer or other type of removable clip 42 that is attached to the mounting rings 32 disposed at the ends of the support cables 24.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An air conditioning mounting system comprising:

a) a building structure having a window with upper and lower sashes; and b) a window mounted air conditioner safety net apparatus comprising:

i) a net assembly being of generally rectangular configuration extending out from said window, said lower sash being in a raised position to form an opening for said net assembly and for an air conditioner unit extending into said net assembly, the net assembly having a top side, a bottom side, side walls, a back wall and an anterior opening for receiving said air conditioner unit therein;

ii) a pair of straps secured to an anterior portion of the top side, the pair of straps each terminating in a clip secured to a top rail of the lower sash;

iii) an elastic band circumferentially attached to a full circumference of the anterior opening of the net assembly to accommodate air conditioners of varying length and width; and iv) elastic members secured to four corners of the elastic band and extending therefrom to the back wall for accommodating air conditioners of varying depth.

2. The mounting system according to claim 1, wherein said pair of straps each comprises dual straps having a buckle therebetween.

3. The mounting system according to claim 2, wherein a first strap of the dual straps is secured to the anterior portion of the top side.

4. The mounting system according to claim 3, wherein a second strap of the dual straps is secured to the clip with a free end passing through the buckle and returnably securable through a fastener to a clip anchored end of the second strap.

5. The mounting system according to claim 4, wherein said fastener comprises mating lengths of hook and loop materials.

6. The mounting system according to claim 2, wherein said buckle has a pivotal plate that provides for one strap of the dual straps to move freely in a first direction while being pulled through said buckle and restricts strap movement while feeding back through said buckle thereby should a user inadvertently lose their grip on the strap, the one strap will not feed backward through the buckle.

7. The mounting system according to claim 6, wherein the pivotal plate has a serrated edge engaging the one strap.

8. The mounting system according to claim 1, wherein said net assembly is manufactured of a material selected from the group consisting of wire, cable and high density fiber.

* * * * *